United States Patent [19]

Baillet et al.

[11] Patent Number: 4,953,384

[45] Date of Patent: Sep. 4, 1990

[54] MAGAZINE-TYPE WIRING ACCESSORY CRIMPING TOOL

[75] Inventors: Alain Baillet, Montville; Francois Loisel, Maromme; Daniel Paulin, Bosc Le Hard, all of France

[73] Assignee: Legrand, Limoges Cedex, France

[21] Appl. No.: 305,638

[22] Filed: Feb. 3, 1989

[30] Foreign Application Priority Data

Feb. 5, 1988 [FR] France ..... 88 01355

[51] Int. Cl.[5] ..... B25B 27/14; H01R 43/042

[52] U.S. Cl. ..... 72/410; 29/751; 29/816; 7/107

[58] Field of Search ..... 72/410, 409, 424; 81/57.37, 431, 434, 415; 29/751, 750, 816; 7/107, 158

[56] References Cited

U.S. PATENT DOCUMENTS

| | | | |
|---|---|---|---|
| Re. 24,604 | 2/1959 | Reider | 81/15 |
| 2,612,932 | 10/1952 | Vinson | 29/816 |
| 3,427,852 | 2/1969 | O'Loughlin et al. | 72/410 |
| 3,583,202 | 6/1971 | Blakeway | 72/410 |
| 3,611,782 | 10/1971 | Eppler | 29/751 |
| 3,707,867 | 1/1973 | Mayala | 72/410 |
| 3,780,416 | 12/1973 | Rider | 72/410 |
| 4,160,317 | 7/1979 | Sergeant | 29/816 |
| 4,173,067 | 11/1979 | Steiner et al. | 29/816 |
| 4,272,883 | 6/1981 | Anthone et al. | 72/410 |
| 4,607,777 | 8/1986 | Ebihara | 227/120 |

FOREIGN PATENT DOCUMENTS

| | | |
|---|---|---|
| 0186914 | 7/1986 | European Pat. Off. . |
| 2193920 | 2/1988 | United Kingdom . |

*Primary Examiner*—Daniel C. Crane

*Attorney, Agent, or Firm*—Charles E. Brown; Charles A. Brown

[57] ABSTRACT

A magazine-type wiring accessory crimping tool comprises two handles articulated to each other which are squeezed together to form at least one crimping deformation in a wiring accessory disposed between them. One of the handles forms a magazine receiving a plurality of parallel wiring accessories to be dispensed and crimped. A dispenser is removably received in this handle and accommodates the plurality of wiring accessories. The other handle incorporates a crimping plate and the first mentioned handle includes a crosspiece aligned with this crimping plate adapted to withstand the crimping force applied by the crimping plate to a wiring accessory.

31 Claims, 4 Drawing Sheets

MAGAZINE-TYPE WIRING ACCESSORY CRIMPING TOOL

BACKGROUND OF THE INVENTION

1. Field of the invention

The present invention is generally concerned with wiring accessories designed to be fitted to the previously stripped end of the stranded conductive core of an electrical conductor to facilitate and render more secure the connection of the conductor to a terminal.

The wiring accessories, usually referred to as terminal connectors, may incorporate an eyelet or a forked or plain tab for making the connection and some types, through which direct connection to the conductor core is made, incorporate an insulative collar. They include a metal shank to be crimped onto the conductive core end and must first be fitted to the latter.

The present invention is particularly directed to the combination of operations necessary to execute a crimp of this kind.

2. Description of the prior art

The first step is to fit the wiring accessory over the conductive core end.

The corresponding crimping must then be done.

Although supplying wiring accessories in strip form was proposed long ago, the accessories routinely available on the market at this time are usually supplied loose in bulk.

They must therefore be taken one by one from a container as required and when executed manually this operation is made all the more difficult in that the wiring accessories are comparatively small.

In any event, this operation inevitably wastes time and it ca also lead to non-negligible wastage of wiring accessories if these are dropped when picked out of the container.

A crimping tool resembling a pair of pliers is usually used to do the crimping.

There are two common types of crimping tool.

In a first type which is relatively light in weight and cheap the crimping entails only a localized deformation of the wiring accessories concerned.

In the second, significantly heavier and more costly type the whole of a wiring accessory of this kind is compacted, introducing some redundancy.

These crimping tools share the disadvantage of imposing a break in the continuity of the operations to be carried out to use them; an operator who has just fitted the wiring accessory to the conductive core end before crimping it usually has to let go of the wiring accessory temporarily to pick up the tool for crimping it.

As a result the wiring accessory may fall off before it is crimped, either because the corresponding operations have not been carried out correctly or because the electrical conductor to be fitted with the accessory is already installed and is difficult of access: this leads to additional wastage of time and materials.

Known crimping tools usually share a further disadvantage in that a plurality of different crimping positions have to be provided alongside each other to cater for a specific range of different wiring accessory sizes (and even so without covering all possible sizes), the operator having to choose the one that is suitable for the wiring accessory he has to crimp.

The hesitation inherent to any such choice can only lead to further wasted time.

The patent US-A-Re.24.604 proposes a dispenser forming a crimping tool; one of its handles forms a magazine and is adapted to receive a plurality of parallel wiring accessories.

Apart from its complexity, this dispenser has the disadvantage of being able to accommodate only one size of wiring accessory, in this specific instance tags.

An object of the present invention is a magazine-type wiring accessory crimping tool that is free of the aforementioned disadvantages.

SUMMARY OF THE INVENTION

The present invention consists in a magazine-type wiring accessory crimping tool comprising two handles articulated to each other and adapted to be squeezed together to form at least one crimping deformation in a wiring accessory disposed between them and one of which is adapted to form a magazine receiving a plurality of parallel wiring accessories to be dispensed and crimped and further comprising a dispenser removably received in said one handle and accommodating said plurality of wiring accessories.

By virtue of its dispensing function the tool in accordance with the invention facilitates the fitting of wiring accessories to be crimped with the benefit of saving time in the corresponding operation.

The necessary manipulation no longer applies to the wiring accessory itself but rather to the dispenser accommodating the wiring accessories which is easier to handle, in particular beause it is larger.

By virtue of the dispenser accommodated in the magazine handle the tool in accordance with the invention advantageously stores wiring accessories pending their fitting and so avoids any undesirable loss of such accessories.

By virtue of its crimping function it advantageously eliminates any specific taking up operations to execute the necessary crimping, so that the fitting and crimping operations can advantageously proceed continuously, with the benefit of further time saving.

However, the invention has the advantage of making it possible to prepare in advance a number of dispensers and so to have available on site a store of wiring accessories ready for use larger than would be provided by the magazine handle of the tool alone.

Furthermore, a dispenser of this kind advantageously constitutes an adapter enabling the same crimping tool to dispense wiring accessories of different sizes, only the internal dimensions of the dispenser varying accordingly.

By virtue of the use of such dispensers the tool in accordance with the invention can cater for a range of wiring accessory sizes that is sufficiently wide to meet the requirements of at least the majority of the market, if not the entire market.

Also, once the tool in accordance with the invention has been loaded with wiring accessories of a particular size, selected to match the electrical conductors to which they are to be fitted, the crimping operation is performed without it being necessary to make any choice between crimping locations, the tool being fitted with a single crimping plate suitable for all wiring accessory sizes that it is likely to receive.

In order for the crimping action on the wiring accessory to be localized the crimping plate comprises a single tooth or a small number of teeth.

Extensive trials have shown that localized deformation is more than adequate to secure the required crimping and durable termination of a stripped conductive core end fitted with a wiring accessory crimped on in this way. Because the crimping deformation is localized the wiring accessory advantageously retains its generally circular contour in cross-section making it particulary easy to insert into the more usual types of terminal, the holes in which themselves have a circular transverse contour.

The tool in accordance with the invention requires only a low operating force and ensures consistent crimping from one wiring accessory to the next since the crimping action is independent of the operator, being achieved as a result of the two handles constituting it coming into abutting relationship with each other at the end opposite that at which the crimping is performed. The material from which the handles are made and their respective dimensions produce a consistent crimping force conditioned by this abutting relationship, possibly at the cost of some bending to absorb effectively different sizes of wiring accessories. The tool is particularly light in weight and therefore easy to handle and it advantageously lends itself to the use of an ergonomic shape which makes it easier and more comfortable to use.

The characteristics and advantages of the invention will emerge from the following description given by way of non-limiting example only with reference to the appended schematic drawings.

DESCRIPTION OF THE PREFERRED EMBODIMENTS

Figure 1:
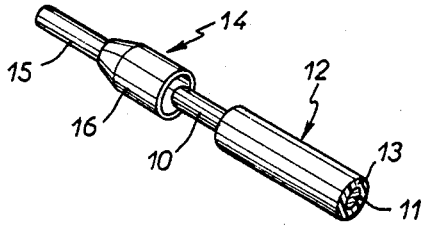
FIG. 1 is a perspective view of an electrical conductor and a wiring accessory to be fitted and crimped to the electrical conductor.
Figure 7:
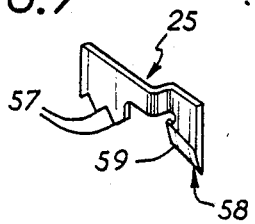
FIG. 7 is a perspective view repeating part of FIG. 2 to a larger scale and concerning the crimping plate fitted to the handle of the crimping tool in accordance with the invention forming a tool.

As shown in the figures and in FIGS. 1 and 14 through 17 in particular the overall task in hand is to fit and crimp to an end 10 of a conductive core 11 of an electrical conductor 12 with an insulative sheath 13 a wiring accessory 14 which comprises for this purpose a metal shank 15.

In the embodiment shown the wiring accessory 14 comprises in addition to the metal shank 15 designed to be fitted over the end of the conductive core 10 of the electrical conductor 12 an insulative material collar 16 designed to fit over the sheath 13 of the the electrical conductor 12.

According to the invention a crimping tool 18 is used to fit and crimp a wiring accessory 14 of this kind.

The crimping tool 18 generally comprises two handles articulated to each other by two pins 19: a handle 20 forms a magazine which is adapted to be loaded with a plurality of parallel wiring accessories 14 to be dispensed by means of a dispenser 21 (hereinafter called the "loader" and described in more detail later), and a handle 22 forms a tool which is fitted with a crimping plate 25 in line with a crosspiece 23 on the magazine handle 20 for it to press against. The crimping plate 25 is designed to make at least one crimping deformation 26 (see FIGS. 15 through 17) in the wiring accessory 14 present between the handles 20 and 22 when the latter are squeezed together, as will be described in more detail later.

The magazine handle 20 and the tool handle 22 cross over at their pivot axis as materialized by the two pins 19 and they form beyond this pivot axis respective jaws 27 and 28, the jaw 27 formed by the magazine handle 20 comprising the crosspiece 23 and the jaw 28 formed by the tool handle 22 comprising the crimping plate 25.

The magazine handle 20 is generally straight.

The crosspiece 23 is at the end of the jaw 27 and is bordered by a rim on three sides, namely a respective longitudinal rim 32 on each of its longitudinal sides and a transverse rim 31 at its free end. In at least one of the longitudinal rims 30, near the aforementioned transverse rim 31, is a notch 32.

The notch 32 is outwardly divergent.

As an alternative to this it may be semicylindrical.

In this specific embodiment there is also a notch 32' on the other longitudinal rim 30 in line with the previously mentioned notch 32. As will subsequently become clear, this is to accommodate any variations in the length of the end of the conductive core 10 to be fitted with the wiring accessory.

The main part 33 at least of the magazine handle 20, by which is meant that part situated beyond the pins 19 relative to its jaw 27, has a U-shaped profile in transverse cross-section with the concave side facing towards the tool handle 22. This profile comprises a bottom 34 and two longitudinal rims 35.

The crosspiece 23 of the jaw 27 is offset in height relative to the bottom 34 of the main part 33, facing towards it.

Similarly, the longitudinal rims 30 of the crosspiece 23 are offset in height relative to the longitudinal rims 35 on the main part 33, although they are aligned with them in the longitudinal direction. The pairs of longitudinal rims 30, 35 conjointly form cheeks 36 where they merge.

Like the main part 33, the jaw 27 has a U-shaped profile in transverse cross-section, defined by its crosspiece 23 and its longitudinal rims 30, but its concave side is inverted relative to that of the main part 33 so that it forms a kind of pocket for the loader 21 adapted to provide an abutment for the end of the loader 21 when, as explained later, the latter is inserted between the longitudinal rims 35 of the main part 33.

As shown here, the magazine handle 20 preferably comprises at its end opposite the crosspiece 23 of the jaw 27 snap fastener means such as recesses or projections for fastening the loader 21 to it, the loader 21 comprising for this purpose complementary snap-fastener means (projections or recesses).

In the embodiment shown the snap-fastener means provided on the magazine handle 20 are recesses.

Figure 2:
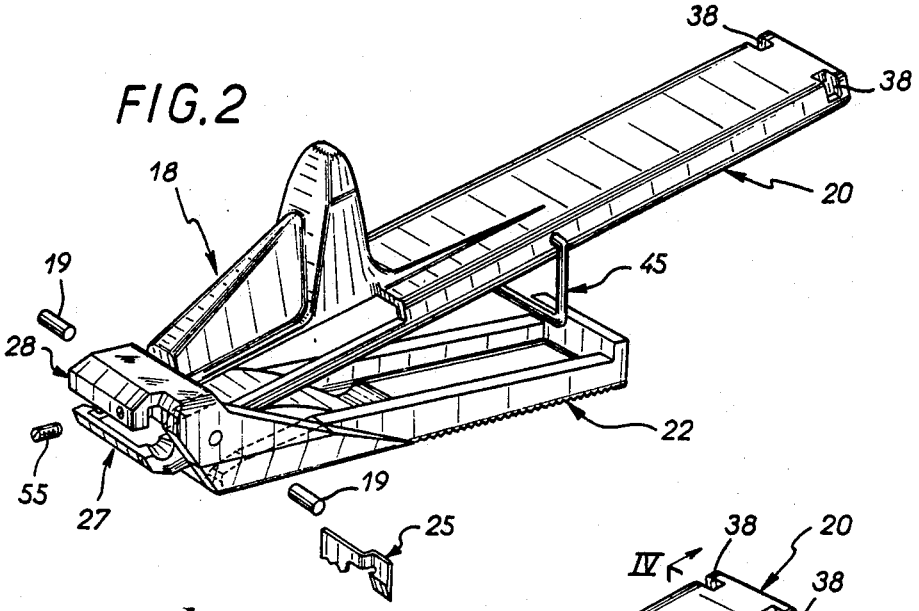
FIG. 2 is a partially exploded perspective view of a crimping tool in accordance with the invention used to perform the fitting and crimping.
Figure 3:
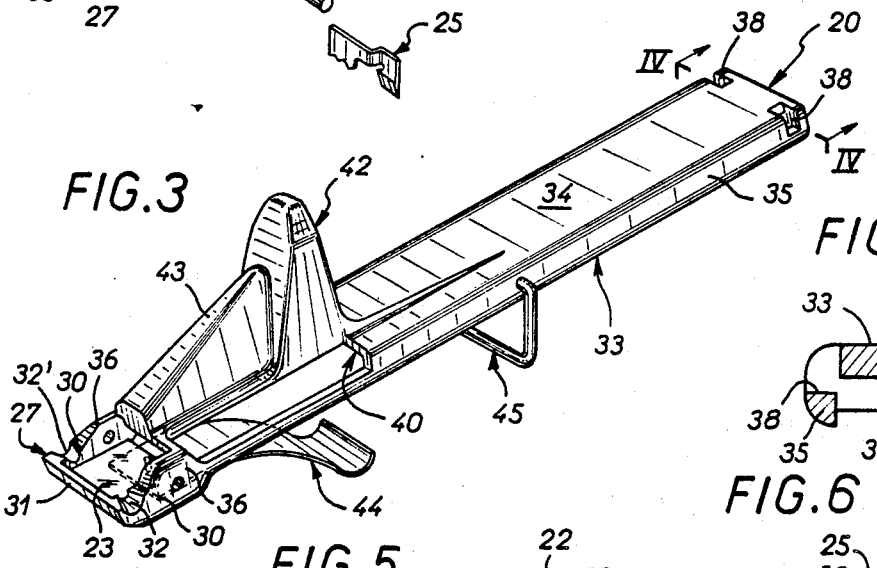
FIG. 3 is a perspective view repeating part of FIG. 2 to the same scale and concerning one handle that the crimping tool comprises and which forms a magazine.
Figure 4:
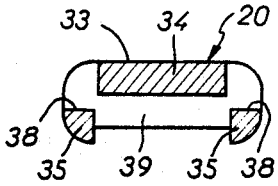
FIG. 4 is a view of the handle forming a magazine in transverse cross-section on the line IV—IV in FIG. 3 and to a larger scale.
Figure 5:
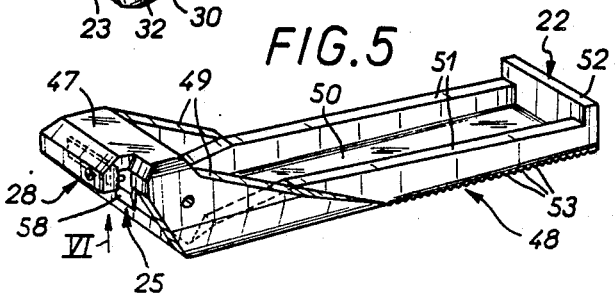
FIG. 5 is a perspective view repeating part of FIG. 2 to the same scale and concerning the other handle that the crimping tool in accordance with the invention comprises and which forms a tool.

These recesses 38 are formed in its longitudinal rims 35 and in a small part of its bottom 34 (FIGS. 2 through 4).

The magazine handle 20 has at the end of its main part 33 between its longitudinal rims 35 a transverse rim 39 at least partially closing off its profile.

The transverse rim 39 is not mandatory, however.

In the embodiment shown the recesses 38 are aligned with the transverse rim 39.

The magazine handle 20 has in its main part 33 near its jaw 27 a longitudinally elongate slot 40 which extends transversely across its bottom 34 and into one of its longitudinal rims 35, namely that corresponding to the longitudinal rim 30 of the jaw 27 comprising the notch 32.

Flanking the slot 40 at the end furthest from the jaw 27 the magazine handle 20 has an externally projecting guard 42 adjoining a rib 43 running along all of the remaining length of the slot 40.

A leaf spring 44 designed to bear on the tool handle 22 is attached to the back of the crosspiece 23 of the magazine handle 20.

Obviously the leaf spring 44 may be replaced by any other form of spring means adapted to urge the handles 20 and 22 apart.

For reasons that will emerge later the magazine handle 20 is provided with a transverse hoop 45 articulated to the middle portion of its main part 33.

To support the crimping plate 45 the tool handle 22 comprises a crosspiece 47 which forms part of the jaw 28 and is offset in height relative to its main part 48, to which it is joined laterally by two cheeks 49.

Like the magazine handle 20 the main part 48 has a U-shaped profile in transverse cross-section with a bottom 50 and longitudinal rims 51 and its concave side faces towards that of the magazine handle 20.

The leaf spring 44 on the magazine handle 20 bears against the bottom 50 of the main part 48.

The tool handle 22 has at the end of the bottom 50 opposite the jaw 28 a transverse rim 52 which in order to provide an abutment for the magazine handle 20 is higher than the longitudinal rims 51 flanking the bottom 50.

The back of the bottom 50 of the main part 48 of the tool handle 22 is formed with transverse grooves 53.

The main part 48 of the tool handle 22 has the same transverse width as the main part 33 of the magazine handle 20, although this is not mandatory.

Its cheeks 49 projecting from the external surface of the longitudinal rims 51 of its main part 48 lie outside the cheeks 36 of the magazine handle 20.

The magazine handle 20 therefore passes through the tool handle 22, so to speak, by virtue of the "bridge" that the crosspiece 47 and cheeks 49 of the latter form.

The pins 19 are accommodated in the respective cheeks 36 and 49.

The handles 20 and 22 are preferably made from a glassfiber-reinforced synthetic material so that they are light in weight and have some degree of elasticity.

The metal crimping plate 25 has one edge inserted into a groove 54 in the tool handle 22 into which it is locked by a retaining screw 55 (or any other appropriate fixing means).

The groove 54 is on the lower surface of the crosspiece 47 of the jaw 28 of the tool handle 22 in the thickness of which is a screwthreaded hole 56 for the fixing screw 55 which intersects the groove 54.

To make a localized crimping deformation 26 in the wiring accessory 14 to be crimped the crimping plate 25 comprises at least one tooth 57.

In the specific embodiment shown the crimping plate 25 comprises two teeth 57 side by side on the edge opposite that inserted into the groove 54 on the tool handle 22, in order to make on the wiring accessory 14 two spaced localized crimping deformations 26.

The wiring accessories shown here to be crimped are adapted to be supplied in strip form linked by their insulative material collar 16. In one piece with the crimping plate 25 and extending it is a cutting blade 58 slightly offset in the transverse direction relative to the remainder of the plate by two bends in opposite senses, the cutting edge 59 of this blade being at a level slightly lower than that of the teeth 57.

The cutting edge 59 may be inclined, as shown here, to reduce the corresponding cutting forces.

In any event, it may extend from either side of the crimping plate 25.

Figure 6:
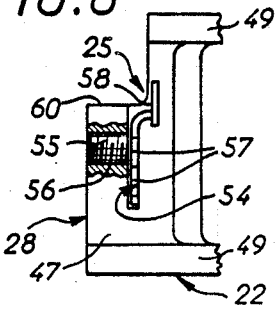
FIG. 6 is a partial view from beneath in the direction of the arrow VI in FIG. 5 and to a larger scale of the handle forming a tool.

The crosspiece 27 of the tool handle 22 is truncated in line with the cutting blade 58 by a cut-out 60 in line with the cutting blade 58 (FIG. 6).

The general shape of the loader 21 is that of an elongate plate the generally parallelepiped-shaped exterior of which is substantially complementary to the interior volume of the magazine handle 20 of the crimping tool 18, this interior volume being that extending between the longitudinal rims 30 and the transverse rim 31 of the jaw 27 of the magazine handle 20, on the one hand, and the longitudinal rims 35 and the transverse rim 39 of its main part 33, on the other hand.

The loader 21 (see FIGS. 8 through 12) comprises a baseplate 62 on which is a projecting bar 63 extending transversely over a distance L1 which is less than the transverse width L2 of the baseplate 62 and which in it has a longitudinal groove 64 along its entire length parallel to said baseplate 62. It further comprises a lip 65 facing, parallel to and spaced from the longitudinal edge of said bar 63 into which the groove 64 opens.

The lip 65 borders one of the longitudinal edges of the baseplate 62. Relative to the lower surface of the latter it has a height H2 which is less than that H1 of the bar 63 which borders the opposite longitudinal side of the baseplate 62.

It may optionally comprise a localized notch in corresponding relationship to the slot 40 in the magazine handle 20 complementary to the corresponding edge of the latter.

It may also optionally comprise a localized notch showing the position of the most forwardly advanced wiring accessory 14.

At one end of the bar 63 on an extension 66 of the baseplate 62 the loader 21 has a cradle 67 adapted to receive a wiring accessory 14. Projecting cantilever fashion and longitudinally from the bar 63 above and spaced from the cradle 67 is a finger 68 adapted to retain a wiring accessory 14 in the cradle 67.

The finger 68 extends from the branch 70 of the bar 63 farthest from the baseplate 62.

It extends only a short distance beyond the centerline of the cradle 67.

Because of the shape of the wiring accessories 14 to be dispensed the cradle 67 is stepped with a smaller transverse cross-section part 67' having the same dimensions as the shank 15 of an accessory in line with the bar 63 and which may have (not shown) an optional ramp surface on the side facing the bar 63 to facilitate the passage of the shank 15, and a larger transverse cross-section part 67" with the same dimensions as the insulative material collar 16 of an accessory in line with the free portion 72 of the baseplate 62, by which is meant the portion of the baseplate 62 between the bar 63 and the lip 65.

As shown here, the cradle 67 is preferably preceded by a ramp surface 73.

Like the cradle 67 the ramp surface 73 is stepped with a part 73' in line with the smaller transverse cross-section part 67' of the cradle 67 and a part 73" in line with the larger transverse cross-section part 67" of the cradle 67.

In an alternative embodiment the part 73" of the ramp surface 73 may be eliminated to facilitate intervention by the cutting blade 58 on the crimping plate 65.

The larger transverse cross-section part 67" of the cradle 67 then reduces to a quarter-cylinder surface along the corresponding transverse edge of the free portion 72 of the baseplate 62.

The lip 65 extends along the full length of the baseplate 62. In line with the cradle 67 it has a notch 74.

As shown here the notch 74 is substantially semi-cylindrical.

To facilitate intervention by the cutting blade 58 the notch 74 is preferably flanked by a notch in the lip 65.

As shown here, at least the branch 70 of the bar 63 farthest from the baseplate 62 preferably has its free edge bevelled by means of a chamfer 76 along all of its length and the same applies to the finger 68 which extend it.

In the embodiment specifically shown here, however, only this branch 70 is bevelled in this way by a chamfer of this kind.

As an alternative to this, however, the other branch 77 of the bar 63 may also have its free edge bevelled by a chamfer along all its length, if required.

The free portion 72 of the baseplate 62 has on its surface from which the bar 63 and the lip 65 project at least one longitudinally projecting detent carried by an elastically deformable tang 80.

In this specific embodiment there are two appropriately spaced elastically deformable tangs 80 and the corresponding detent is formed by the raised end of one such elastically deformable tang 80.

As an alternative to this the elastically deformable tangs 80 may be straight and the detent that they carry may be formed by a projecting bead.

To make the loader 21 easier to handle its baseplate 62 comprises at the end opposite the cradle 67 an extension 81 in the form of a tab.

The lip 65 does not extend over this extension 81, although it does extend over the extension 26.

At the end opposite the cradle 67 the bar 63 and the baseplate 62 comprise respective snap-fastener means such as projections or recesses adapted to cooperate snap-fastener fashion with complementary snap-fastener means in the form of recesses or projections.

In the specific embodiment shown these snap-fastener means comprise projections 82, of which there is one on the bar 63 and another on the lip 65, designed to cooperate snap-fastener fashion with the recesses 38 in the magazine handle 20 of the crimping tool 18.

As far as the bar 63 is concerned the projection 82 is in one piece with its longitudinal edge opposite the lip 55, the projection 82 being in the immediate vicinity of the intersection between this longitudinal edge and the opposite surface of the baseplate 62.

As far as the lip 65 is concerned, the projection 82 is at the end of a finger 83 so that it is level with the other projection 82.

Projecting from the side of the baseplate 62 opposite that from which the elastically deformable tangs 80 project and at a distance from the elastically deformable tangs 80 are two elastically deformable blades 84 defining between them a transverse housing 85 adapted to receive the central part of the hoop 45 carried by the magazine handle 20 of the crimping tool 18.

To facilitate molding the elastically deformable blades 84 and the previously mentioned elastically deformable tangs 80 flank holes through the baseplate 62.

Also to facilitate molding the bar 63 and the baseplate 62 are parts of respective separate flaps 87 and 88 fastened to each other in some suitable way.

The flap 88 comprises the lip 65 and the baseplate 62.

In this specific embodiment the cradle 67 is divided between the two flaps 87 and 88 with its smaller transverse cross-section part 67' on the flap 87 and its larger transverse cross-section part 67" on the flap 88.

As an alternative to this it may be carried by the flap 88 only, there being a notch aligned with it on the flap 87.

The flap 87 bears on a portion 89 of the baseplate 62 the surface of which is set back slightly relative to that of its free portion 72, being separated from the latter by a shoulder 90.

The flaps 87 and 88 are hinged together by a hinge line 92 extending along the edge of the baseplate 62 opposite that along which the lip 65 extends.

Figure 12:
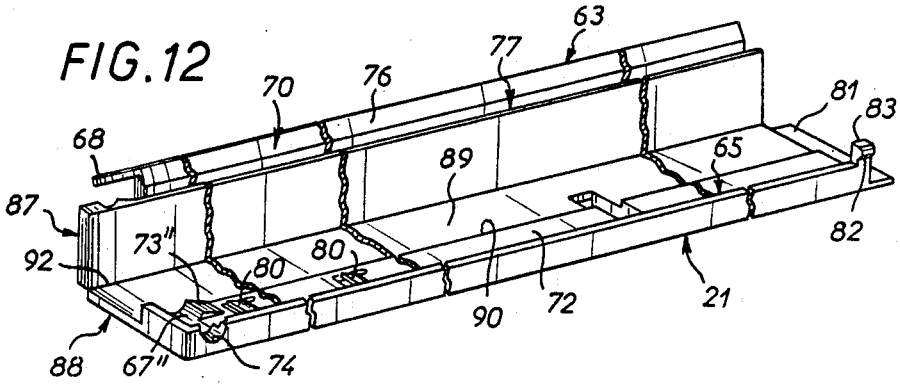
FIG. 12 is a view of it in perspective showing how it is molded.

As shown in FIG. 12 the loader 21 can therefore be molded by means of a mold with no mold slide in a configuration in which the flap 87 is substantially perpendicular to the flap 88.

After molding it is sufficient to fold the flap 87 against the flap 88 and fasten it thereto.

In the embodiment shown in FIGS. 1 through 17 the corresponding fastening is achieved by adhesive bonding, and the flap 87 and/or 88 can if required comprise one or more recesses for receiving dabs of adhesive.

Fastening may also be achieved by welding, for example high-frequency welding, ultrasonic welding, spot heat welding or otherwise.

Figure 18:
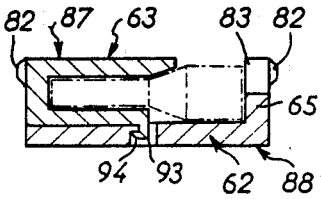
FIG. 18 is a view in transverse cross-section analogous to that of FIG. 11 relating to an alternative embodiment of the dispenser associated with the crimping tool.

As an alternative to this (FIG. 18) it is the result of snap-fastener action, the flap 87 comprising spaced hooks 93, for example, by means of which it can engage snap-fastener fashion in the thickness of the baseplate 62 of the flap 88, over lugs 94 provided for this purpose, by means of openings in the baseplate 62.

Figure 8:
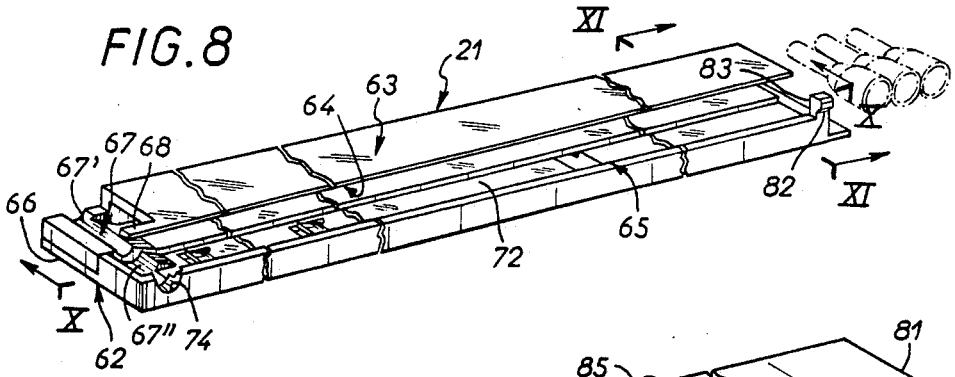
FIG. 8 is a perspective view as seen from above of a dispenser associated with the crimping tool.
Figure 9:
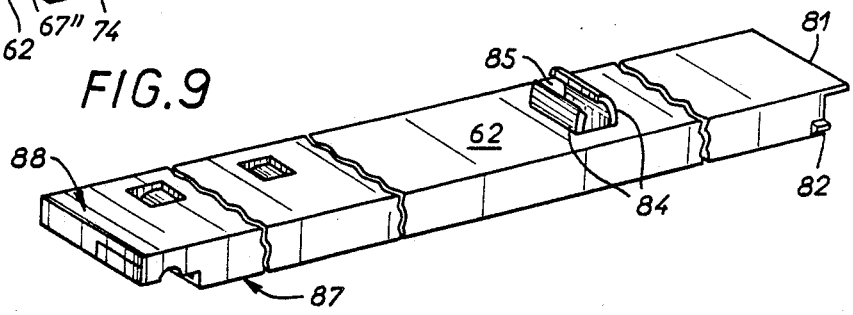
FIG. 9 is a perspective view of the dispenser seen from below.
Figure 10:
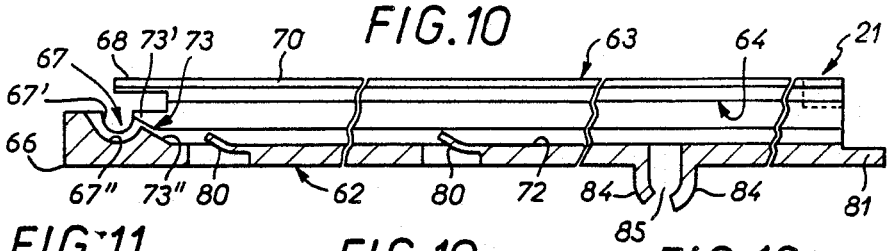
FIG. 10 is a view of the dispenser to a larger scale and in partial longitudinal cross-section on the line X—X in FIG. 8.
Figure 11:
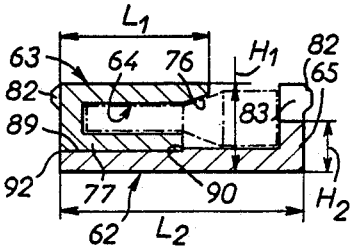
FIG. 11 is a view of it in transverse cross-section on the line XI—XI in FIG. 8.

When the flaps 87 and 88 constituting the loader 21 are applied one against the other it suffices to insert the wiring accessories 14 to be dispensed at one end of the loader and into the groove 64 of the bar 63 constituting its flap 87, as schematically represented in chain-dotted outline in FIG. 8, the groove 64 being longitudinally open at both ends.

Of course, the arrangements are such that the width of the groove 64 corresponds to the diameter of the metal shank 15 of the wiring accessories 14 and so that the distance between bar 63 and the lip 65 corresponds to the height of the insulative material collar 16.

Figure 19:
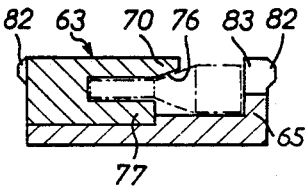
FIG. 19 is a view in transverse cross-section also analogous to that of FIG. 11 showing the adapter function of the dispenser.

As shown in FIG. 19 the loader 21 may therefore advantageously serve as an adapter between the wiring accessories 14 and the crimping tool 18.

While having the same external dimensions adapted as already mentioned to the internal dimensions of the magazine handle 20 of the crimping tool 18, the loader may have internal dimensions corresponding, at least within certain limits, to various possible different sizes of the wiring accessories 14 to be dispensed.

The same crimping tool 18 may therefore be advantageously suitable for a number of different sizes of wiring accessories 14, the loader 21 to be fitted into its magazine handle 20 being chosen appropriately.

In the case of the present type of accessory the crimping tool may advantageously be suitable for sizes of 0.5 - 0.75 -1 - 1.5 - 2.5 $mm^2$, accounting for more than 90% of the current market for accessories of this type in sizes from 0.5 to 50 $mm^2$.

To distinguish the various loaders 21 that can be associated with one and the same crimping tool 18 from each other the loaders 20 may be different colours, for example.

Of course, the wiring accessories 14 may be placed in a loader 21 of this kind individually, one after the other.

Preferably, however, and as already mentioned, they are supplied in strip form which facilitates and accelerates loading them.

Figure 13A:
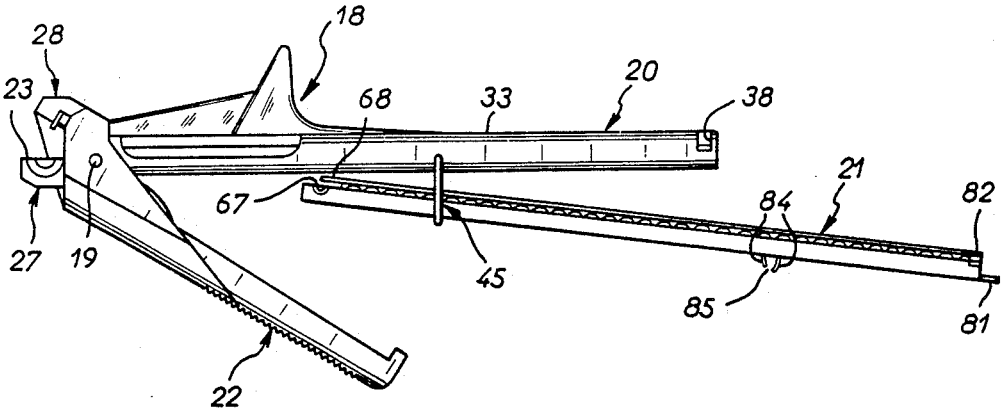
FIG. 13A is a view in elevation showing the fitting of the dispenser.
Figure 13B:
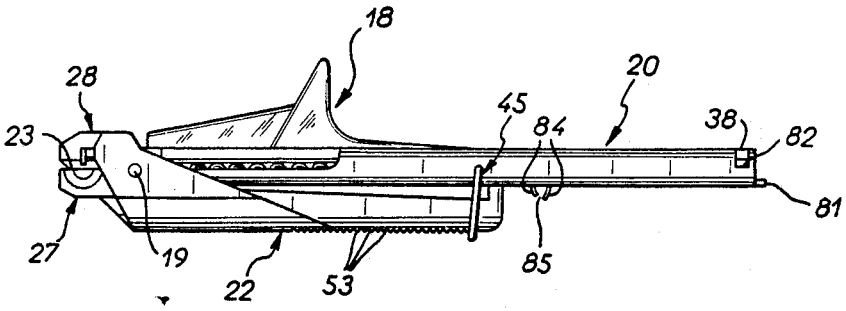
FIG. 13B is a view in elevation showing the crimping tool in accordance with the invention fitted with a dispenser of this kind in the storage condition.

The hoop 45 fitted to the magazine handle 20 may advantageously be used, as shown in FIG. 13A, for fitting a loader 21 filled in this way with wiring accessories 14 into the magazine handle 20 of the crimping tool 18.

To this end the hoop 45 is deployed to an angle of substantially 90° relative to the main part 33 of the magazine handle 20 and the end of the loader 21 incorporating the cradle 67, facing towards the magazine handle 20, is inserted therein, which facilitates guiding it towards the jaw 27 of the magazine handle 20.

When the corresponding transverse edge of the loader 21 abutts against the transverse rim 31 of the jaw 27 it is exactly positioned in the magazine handle 20 and it may then be snap-fastened into the latter simply by elastically deforming its projections 82 into the compelementary recesses 38 which the magazine handle 20 comprises for this purpose.

Only the tab constituting the extension 81 of the baseplate 62 then projects from the handle, this tab being designed to facilitate subsequent extraction of the loader when all the wiring accessories 14 that it contains have been used or to change the size of the wiring accessories.

When not in use (FIG. 13B) the tool handle 22 is moved against the leaf spring 44 towards the magazine handle 20 and the hoop 45 carried by the latter is placed over it to engage with one of the grooves 53 on its back. It is therefore held near the magazine handle 20 so that the storage configuration of the device is advantageously minimized.

To use the crimping tool 18 (FIGS. 14A, 14B, 14C) the hoop 45 carried by the magazine handle 20 is disengaged from the tool handle 22 and its middle part is engaged in the housing 85 defined by the elastically deformable blades 84 of the loader 21 in the magazine handle 20, which reinforces the positioning of the loader 21 in the magazine handle 20.

The jaws 27, 28 of the crimping tool 18 being separated at this time the operator can use his thumb to push forward the wiring accessories 14 in the loader 21 in the handle 20, through the slot 40.

To facilitate this action the slot 40 may become deeper in the direction towards the jaws 27,28.

The first wiring accessory 14 moves beyond the ramp surface 73 into the cradle 67 in line with the crimping plate 25 caried by the tool handle 22. The elastically deformable tangs 80 in the loader 21 oppose any retrograde movement of the strip that the remaining wiring accessories 14 preferably constitute.

The operator then has only to insert the electrical conductor 12 to be fitted with a wiring accessory (FIG. 14A) into the wiring accessory 14 in the cradle 67 by means of the notch 32 in the magazine handle 20 and the notch 74 in the loader 21 in front of the cradle 67.

Figure 14A:
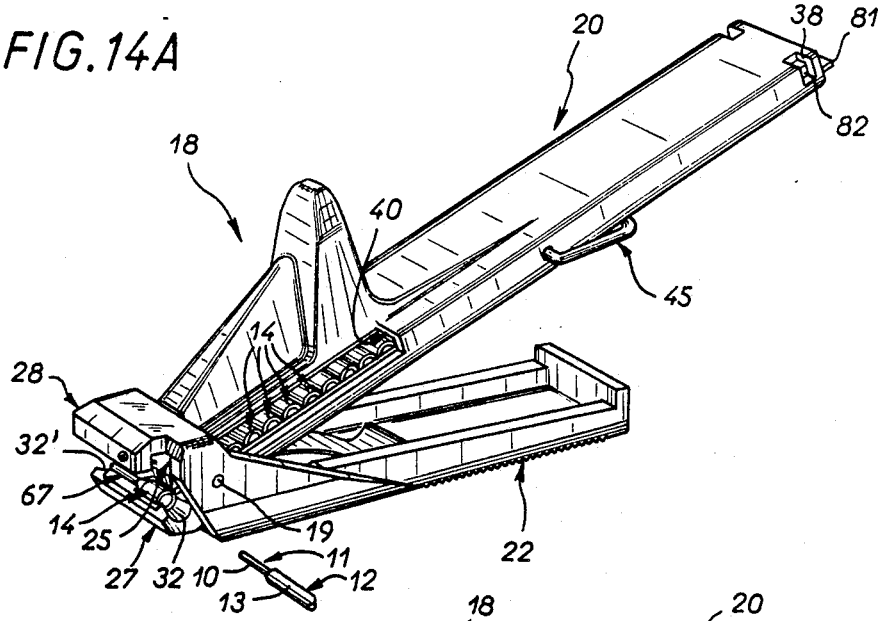
FIGS. 14A, 14B and 14C are perspective views analogous to that of FIG. 2 showing how the crimping tool in accordance with the invention is used.
Figure 14B:
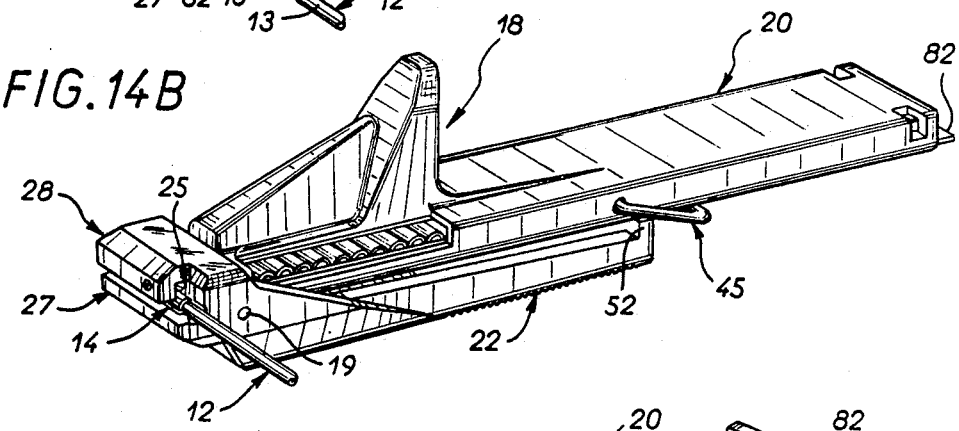
Figure 14C:
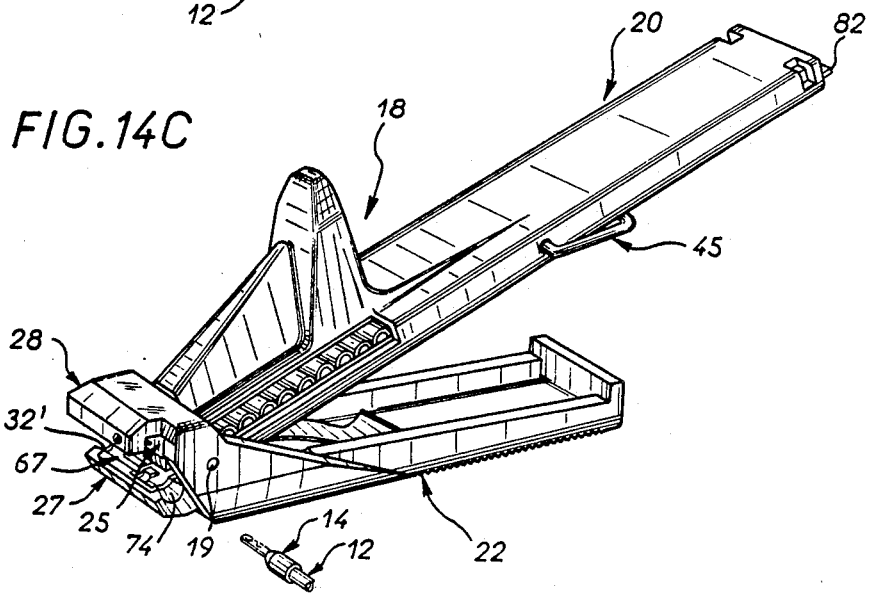

When the handles 20 and 22 are squeezed together as shown in FIG. 14B the teeth 57 of the crimping plate 55 on the tool handle 22 engage the metal shank 15 of the wiring accessory 14 concerned and immediately form the localized crimping deformations 26 needed to crimp it onto the end 10 of the conductive core 11 of the electrical conductor 12, the force applied by the crimping plate 25 being resisted by the crosspiece 23 of the magazine handle 20. At the same time the cutting blade 28 cuts the link between this wiring accessory 14 and the next one.

As will be noted, the corresponding cutting is therefore advantageously carried out at the same time as the crimping.

At the end of squeezing together the handles 20 and 22 and even though the required crimping has been accomplished beforehand the magazine handle 20 bears against the transverse rim 52 forming an abutment provided for this purpose on the tool handle 22, possibly at the cost of slight elastic bending on its part which guarantees correct crimping irrespective of the size of the wiring accessory 14 concerned.

When the handles 20 and 22 have been released (FIG. 14C) it remains only to withdraw the electrical conductor 12 which takes with it the wiring accessory 14 that has been crimped to it.

Figure 15:
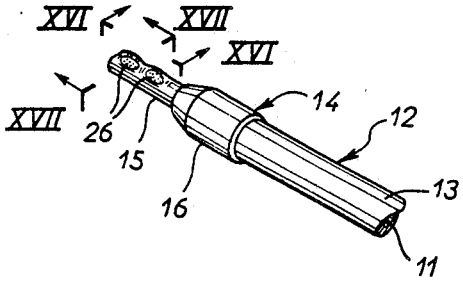
FIG. 15 is a perspective view analogous to that of FIG. 1 showing the crimping performed by means of this crimping tool.
Figure 16:
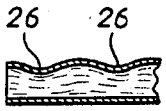
FIGS. 16 and 17 are views of this crimping to a larger scale in cross-section on the respective lines XVI—XVI and XVII—XVII in FIG. 15.
Figure 17:
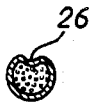

As previously mentioned and as can be seen in FIGS. 15 through 17 both of the corresponding localized deformations 26 advantageously affect only a localized part of the shank 15 of the wiring accessory 14 so that the overall transverse cross-section of the shank 15 is not significantly altered.

To fit a wiring accessory to another electrical conductor 12 the previously described operations are repeated, the wiring accessories 14 being advanced each time by one step.

It will be readily understood that the finger 68 on the loader 21 above its cradle 67 advantageously secures the last of these wiring accessories 14 in the cradle.

Of course, the present invention is not limited to the embodiments described and shown but encompasses any variant execution thereof.

In particular the handles of the crimping tool in accordance with the invention can also form levers of a different kind than that of the levers which they form in the embodiments specifically described and shown; for example, instead of being articulated to each other like pliers they could be articulated like nutcrackers.

Although in the embodiment specifically described and shown the cradle receiving the wiring accessory to be crimped is part of the loader associated with the crimping tool in accordance with the invention it could equally well form part of the crimping tool itself, in which case the cradle would be interchangeable or a crimping tool could be provided for each of the various sizes of wiring accessories to be crimped.

The same goes for the retaining finger overlying this cradle.

There is claimed:

1. Magazine-type wiring accessory crimping tool comprising two handles articulated to each other, one of said handles defining a magazine removably receiving a dispenser, said dispenser accommodating a plurality of wiring accessories disposed parallel to one another, said dispenser being insertable into said magazine for loading the plurality of wiring accessories thereinto, access means through said magazine for providing direct access to wiring accessories in said dispenser to advance the same towards crimping means, said crimping means being defined on a first of said handles for forming at least one crimping deformation in a wiring accessory in position between said handles when squeezed together, the other of said handles being the first handle, said crimping means comprising a crimping blade, said one handle including a crosspiece aligned when the handles are squeezed together with said crimping blade, said crosspiece being adapted to withstand crimping force applied by said crimping blade, said handles crossing each other at an articulation zone where the handles are articulated to each other, free ends of said handles being adjacent said articulation zone, and constituting respective jaws, and the jaw on said one handle incorporating said crosspiece and the jaw on said other handle incorporating said crimping blade.

2. The tool according to claim 1, wherein said crosspiece is at an end of said one handle which further comprises a respective rim flanking said crosspiece on each of three sides, and includes a longitudinal rim on each of two longitudinal edges and a transverse rim on a transverse edge, and a notch in at least one of said longitudinal rims near said transverse rim.

3. The tool according to claim 1, wherein said other handle includes a groove into which an edge portion of said crimping blade is inserted and fixing means for fixing said crimping blade in said groove.

4. A magazine-type wiring accessory crimping tool comprising two handles articulated to each other, one of said handles defining a magazine removably receiving a apertured dispenser, said dispenser freely accommodating a plurality of wiring accessories arranged freely parallel to one another, said dispenser being insertable into said magazine for loading the plurality of wiring accessories thereinto, access means through said magazine for providing direct access for an operator's fingers to wiring accessories in said dispenser to advance the same towards crimping means, said crimping means being defined on a first of said handles for forming at least one crimping deformation in a wiring accessory in position between said handles when squeezed together.

5. The tool according to claim 4, wherein the other of said handles is the first handle, said crimping means comprises a crimping blade, said one handle includes a crosspiece aligned when the handles are squeezed together with said crimping blade, said crosspiece is adapted to withstand crimping force applied by said crimping blade.

6. The tool according to claim 5, wherein at least a main part of said one handle has a U-shaped transverse cross-section defining a medial wall and longitudinal rims which together with said longitudinal rims on said crosspiece form respective cheeks and wherein said crosspiece is offset in height relative to said medial wall.

7. The tool according to claim 4, wherein said one handle and said dispenser comprise respective and complementary detent means for releasably securing said dispenser to said one handle.

8. The tool according to claim 4, wherein said access means comprise a slot in a main part of said one handle relatively adjacent to an articulation zone where the handles are articulated together.

9. The tool according to claim 4, wherein said tool comprises an outwardly projecting guard on said one handle relatively adjacent to an articulation zone where the handles are articulated.

10. The tool according to claim 4, wherein said tool comprises a transverse hoop articulated to said one handle.

11. The tool according to claim 5, wherein said other handle comprises a crosspiece offset in height relative to its main part and supports said crimping blade, two lateral cheeks join said crosspiece to said main part of said other handle.

12. The tool according to claim 6, wherein said other handle comprises a crosspiece offset in height relative to its main part and supports said crimping blade, two lateral cheeks join said crosspiece to said main part of said other handle, said cheeks on said one handle is disposed between said cheeks on said other handle.

13. The tool according to claim 6, wherein said other handle comprises a crosspiece offset in height relative to its main part and supports said crimping blade, two lateral cheeks join said main part of said other handle, said handles are articulated about an axis extending through the respective cheeks.

14. The tool according to claim 5, wherein said crimping blade comprises at least one tooth for defining at the least one crimping deformation in a wiring accessory.

15. The tool according to claim 5, wherein said crimping blade comprises in one piece there with a cutting blade slightly transversely offset relative to the remainder of said crimping plate.

16. The tool according to claim 15, wherein said crosspiece of said other handle includes a cut-out in line with said cutting blade whereby it is truncated.

17. The tool according to claim 4, wherein said crimping means comprises a crimping blade rigidly fixed to said first of said handles.

18. The tool according to claim 4, wherein a crimping position for a leading one of the terminal connectors disposed at an end of said handles for permitting insertion of a conductor into the leading wiring accessory transversely relative to the direction of forward advancement of the wiring accessories in the dispenser.

19. Magazine-type wiring accessory tool comprising two handles articulated to each other, one of said handles defining a magazine removably receiving a dispenser, said dispenser accommodating a plurality of wiring accessories disposed parallel to one another, said dispenser being insertable into said magazine for loading the plurality of wiring accessories thereinto, access means through said magazine for providing direct access to wiring accessories in said dispenser to advance the same towards crimping means, said crimping means being defined on a first of said handles for forming at least one crimping deformation in a wiring accessory in position between said handles when squeezed together, said dispenser accommodating said wiring accessories transversely and comprising an elongate plate member incorporating a baseplate, a transverse bar projecting from said baseplate over less than its full width, the bar having a longitudinal groove parallel to said baseplate extending the full length thereof, a lip being parallel to and spaced from the longitudinal edge of said bar into which said groove opens, a cradle being proximate a leading end of said dispenser and being adapted to receive a leading wiring accessory and a cantilevered longitudinal finger overlying and being spaced from said cradle adapted to retain the leading wiring accessory in said cradle.

20. The tool according to claim 19, wherein said bar comprises two branches generally parallel to said baseplate.

21. The tool according to claim 19, wherein said finger extends only a short distance beyond a centerline of said cradle.

22. The tool according to claim 19, wherein said cradle is stepped and comprises a smaller transverse cross-section part in line with said bar of said dispenser and a larger transverse cross-section part in line with a free portion of said baseplate.

23. The tool according to claim 19, wherein said tool comprises a ramp surface upstream of said cradle relative to the direction in which said wiring accessories move in said dispenser to said cradle.

24. The tool according to claim 19, wherein said lip on said dispenser comprises a notch in line with said cradle.

25. The tool according to claim 19, wherein said cradle is part of said dispenser and is disposed transversely at one end of said bar an extension of said baseplate carrying said cradle.

26. The tool according to claim 19, wherein at least the branch of said bar further from said baseplate has a bevelled free edge along its full length.

27. The tool according to claim 19, wherein said baseplate includes a free part between said bar and said lip, an elastically deformable tang on said free part and at least one longitudinally projecting detent carried by said tang.

28. The tool according to claim 19, wherein said tool comprises an extension to said baseplate at the end thereof opposite said cradle.

29. The tool according to claim 19, wherein at least the respective ends of said bar and said baseplate comprise respective and complementary detent means.

30. The tool according to claim 19, wherein said dispenser comprises two separate flaps fastened together and said bar and said baseplate each form part of a respective flap.

31. The tool according to claim 30, wherein said tool further comprises an extension of said baseplate carrying said cradle and wherein said cradle is part of said dispenser, is disposed transversely at one end of said bar and is divided between said two flaps.

* * * * *